United States Patent [19]

Stevens

[11] 4,254,315

[45] Mar. 3, 1981

[54] BACK-LIGHTED PUSH-BUTTON SWITCH WITH SAFETY STOP

[75] Inventor: Curtis R. Stevens, El Toro, Calif.

[73] Assignee: Master Specialties Company, Costa Mesa, Calif.

[21] Appl. No.: 47,028

[22] Filed: Jun. 11, 1979

[51] Int. Cl.[3] ..... H01H 9/16; H01H 3/12

[52] U.S. Cl. ..... 200/153 J; 200/314

[58] Field of Search ..... 200/153 J, 159 R, 325, 200/328, 314

[56] References Cited

U.S. PATENT DOCUMENTS

| | | | |
|---|---|---|---|
| 3,437,775 | 4/1969 | Piber | 200/314 |
| 3,509,300 | 4/1970 | Hipple | 200/328 |
| 3,517,148 | 6/1970 | Di Pilla | 200/325 |
| 3,523,168 | 8/1970 | Holmes | 200/159 R |
| 3,566,705 | 3/1971 | Frydman | 200/153 J |
| 3,602,678 | 8/1971 | Laete | 200/325 |
| 3,947,651 | 3/1976 | Fuller | 200/314 |
| 4,096,368 | 6/1978 | Grebner | 200/153 J |
| 4,161,637 | 7/1979 | Priesemuth | 200/153 J |

*Primary Examiner*—John W. Shepperd
*Attorney, Agent, or Firm*—Christie, Parker & Hale

[57] ABSTRACT

A panel-mounted push-button assembly having an illuminated push-button removable from the front of the panel has a safety locking mechanism for preventing accidental operation of the push-button switch when the push-button is reinserted into operative position. The locking mechanism includes a cam member having a groove engaged by a cam follower. The groove is in the form of a closed loop path. The push-button is linked to the locking mechanism so that movement of the push-button moves the cam follower relative to the cam member along the groove. In the normal operating position the cam follower is in an intermediate position along the loop. When the push-button is pulled from the panel to remove it from the switch assembly, the cam follower is moved from the initial position to an end position. When the push-button is replaced by pushing it back into position, the cam follower is moved along a return path portion of the loop against a stop, limiting the movement of the push-button and allowing the push-button to be reseated in the switch assembly. When the push-button is released, a spring returns it to the initial position. Subsequent pushing action of the push-button causes the cam follower to move along a branch path away from the loop, allowing the push-button to be depressed sufficiently to actuate the switch mechanism.

9 Claims, 14 Drawing Figures

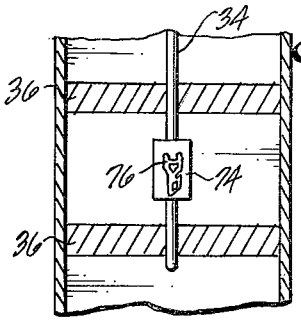
Fig. 5
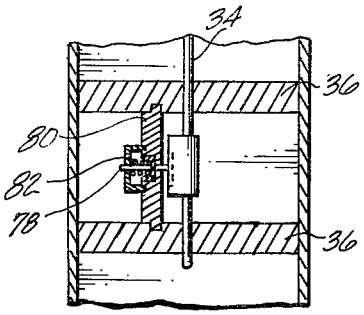
Fig. 6
Fig. 7
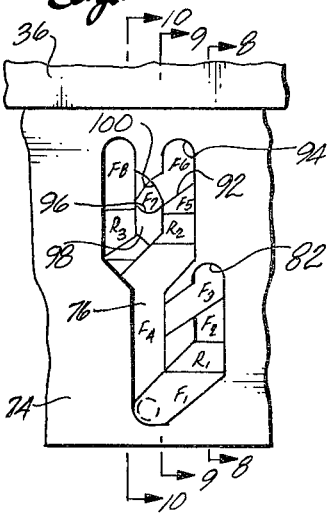
Fig. 8
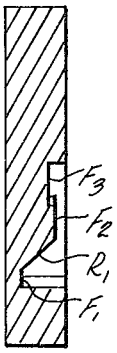
Fig. 9
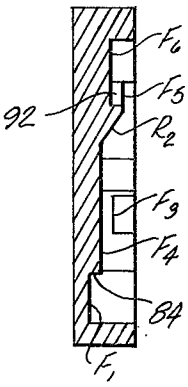
Fig. 10
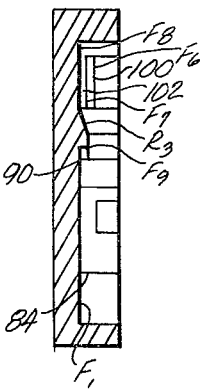
Fig. 11
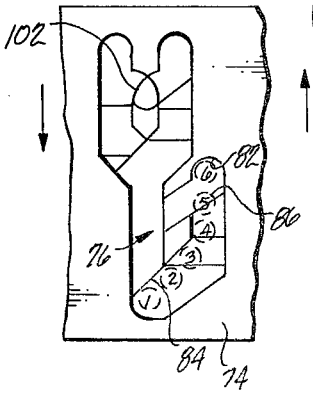
Fig. 12
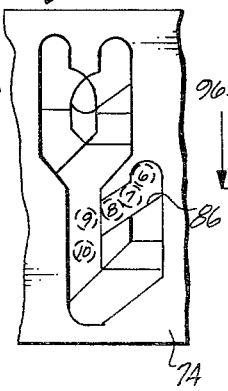
Fig. 13
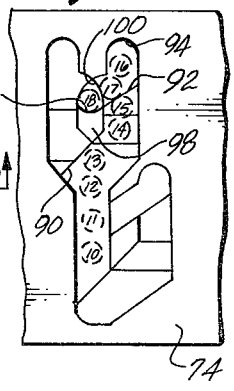
Fig. 14
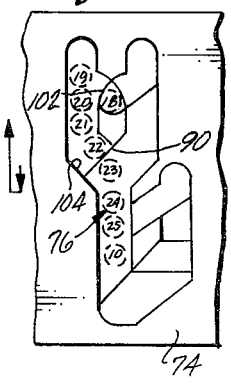

BACK-LIGHTED PUSH-BUTTON SWITCH WITH SAFETY STOP

FIELD OF THE INVENTION

This invention relates to illuminated push-button switches, and more particularly, to a safety stop mechanism for a push-button switch having a removable push-button.

BACKGROUND OF THE INVENTION

Panel-mounted push-button switches are well known in which a push-button projects from the front of a panel and the switch is actuated by depressing the push-button. The face of the push-button may be illuminated from the rear by lamps mounted in the switch assembly behind the push-button. It is desirable to be able to gain access either to the switch mechanism or to the lamps from the front of the panel by removing the push-button. To permit the push-button to be removed without tools of any sort, the push-button may be secured to the rest of the switch mechanism by frictional engagement or a suitable detent mechanism which allows the push-button to be withdrawn by pulling strongly on the projecting portion of the push-button. After relamping or other maintenance is completed, the push-button is replaced by pushing it back into position from the front of the panel.

While push-button assemblies of this type are convenient to service, one problem has been the likelihood of accidental actuation of the switch itself when the push-button is reinserted into its operative position. The very act of reinserting of the push-button by pushing it into place causes the push-button to actuate the switch.

SUMMARY OF THE INVENTION

The present invention is directed to a panel-mounted type push-button switch having a removable push-button. The push-button is removed by pulling it away from the panel and associated switch assembly mounted in the panel. The push-button is replaced by pushing the button back into place in the switch mechanism through the front of the panel. A unique safety lock mechanism prevents the switch from being actuated while the push-button is being removed and reinserted. The safety lock mechanism is automatically set by the action of removing the push-button and is automatically released by the action of returning the push-button to its operative position.

This is accomplished, in brief, by a cam mechanism operated by the linkage which operatively connects the push-button with the electrical switch. The cam mechanism includes a cam member and a cam follower movable in relation to the cam member. When in the operative condition, the cam follower and cam member are positioned in an initial or "home" position in which the push-button can be moved between the "on" and "off" positions by pressing on and releasing the push-button. When the push-button is pulled away from the switch assembly, the cam follower is moved relative to the cam member to an intermediate position. When the push-button is pushed back into assembled condition and re-engaged with the switch linkage, the cam follower moves to a "stop" position relative to the cam member, limiting movement of the linkage and preventing the actuation of the switch. After pushed back into position, the push-button is released and the cam follower is moved back to the "home" position relative to the cam by a spring. Pushing on the button when the cam follower is in the "home" position actuates the switch in the normal manner.

DESCRIPTION OF THE DRAWINGS

For a better understanding of the invention reference should be made to the accompanying drawings, wherein:

FIG. 5 is a partial sectional view of an alternative embodiment of the present invention;

FIG. 6 is a sectional view taken substantially on the line 6—6 of FIG. 5;

FIG. 7 is a sectional view taken substantially on the line 7—7 of FIG. 6; and FIGS. 8–14 are a series of schematic diagrams showing relative movement between the cam follower and the cam in the embodiment of FIGS. 5–7.

DETAILED DESCRIPTION

Figure 1:
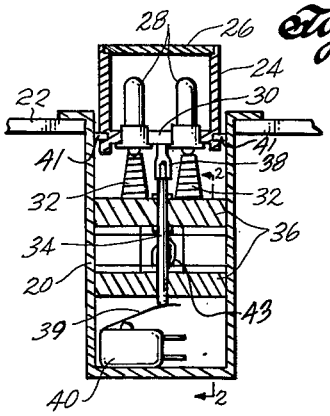
FIG. 1 is a cross-sectional view of one embodiment of the present invention.
Figure 2:
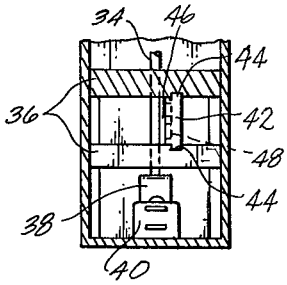
FIG. 2 is a sectional view taken substantially on the line 2—2 of FIG. 1.

Referring to the arrangement shown in FIGS. 1–4, there is shown a push-button switch incorporating the features of the present invention. The switch assembly includes an outer cup-shaped housing 20 adapted to be mounted in a panel 22 in any conventional manner. The push-button switch assembly includes a push-button 24 having a screen 26 which is illuminated by one or more lamps 28 inserted in the base 30 of the push-button 24. As shown in FIG. 1, the push-button 24 is in its normal operative position. The push-button is urged into this position by coil springs 32 which extend between a pedestal or frame member 34 mounted in the housing 20. The springs engage the center contacts of the lamps 28 so as to provide an electrical contact to the lamps.

The push-button 24 is movably mounted in the housing 20 by means of a rod 34 which is journaled for longitudinal motion in a pair of spaced guide members 36 mounted in the housing 20. The upper end of the rod 34 is releasably secured to the push-button 24 by a spring socket 38 or other suitable friction or detent means for allowing the push-button 24 to be pulled loose from the rod 34. The lower end of the rod 34 engages a spring finger 39 which operates to actuate a microswitch 40. A gasket 41 mounted in a groove extending around the lower end of the push-button 24 slidably engages the inner surface of the housing 20 to seal off the interior of the switching assembly while allowing the push-button 24 to be moved to actuate the switch or to withdraw the push-button by pulling on the push-button to disengage it from the rod 34.

From the above description it will be appreciated that the push-button 24 can be removed from the switch assembly without removing the housing by pulling the push-button away from the rod 34. This may be done to replace the lamps 28, change the legend on the screen 26, or to provide access to the switch 40 from the front panel. However, on reinserting the push-button 24 onto the rod 34, the rod 34 is inevitably depressed sufficiently to actuate the switch 40, which may result in completing or disconnecting an electrical circuit when that result is not appropriate. The present invention is directed to a safety mechanism for preventing the operation of the switch during the removal and replacement of the push-button 24 on the end of the rod 34. This feature may be combined with an automatic lock and release mechanism for holding the push-button switch in the "in" position when the push-button is depressed and releasing the push-button when it is depressed the second time.

Figure 3:
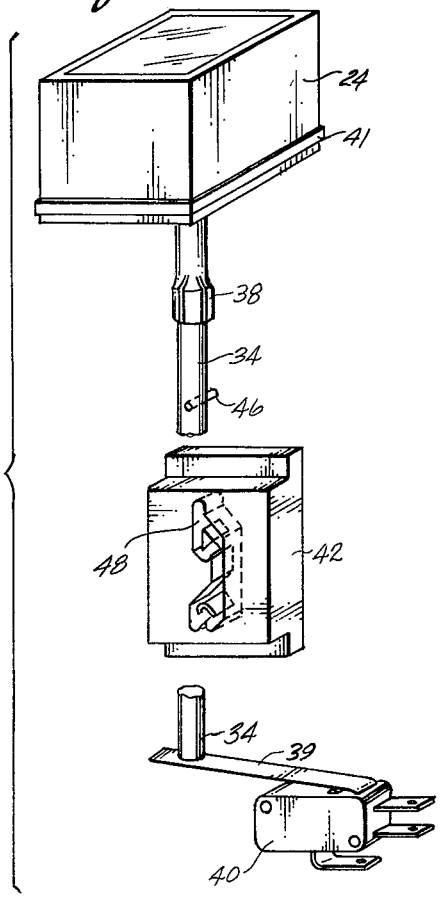
FIG. 3 is a schematic showing in perspective.
Figure 4:
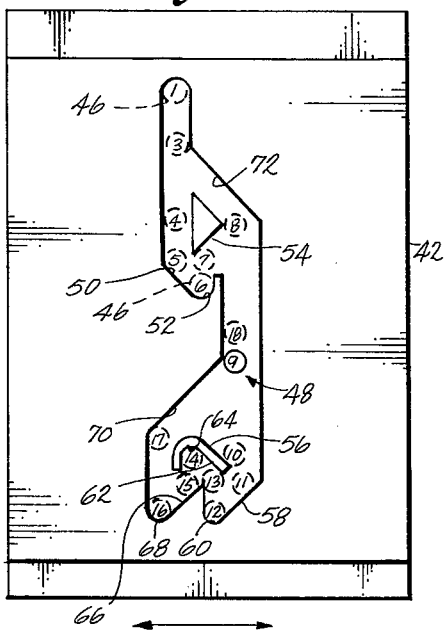
FIG. 4 is a plan view of the cam slide showing successive positions of the cam follower.

The safety stop and lock mechanism is shown in more detail in FIGS. 3 and 4. The stop assembly includes a cam member 42 in the form of a slide guided along a horizontal path, as viewed in FIGS. 1 and 2, by guide grooves 44 in the guide members 36. A cam follower in the form of a pin or roller 46 projects from the rod 34 into a cam groove formed in the surface of the slide 42. For clarity in FIG. 3, the rod 34 is separated and the cam follower pin 46 moved above the slide 42 to show the cam groove 48 more clearly. As viewed in FIG. 4, the circled numbers indicate the various positions of the cam follower pin 46 as it is moved relative to the cam groove 48 by operation of the push-button 24. When the push-button 24 is removed, the rod 34 pulls the pin 46 into position 1 against a stop, as shown in FIG. 4. The stop at 1 limits the outward movement of the rod 34 and allows the push-button to be pulled apart from the end of the rod. When the push-button is reinserted onto the end of the rod 34, the pin 46 is moved by the rod 34 down a vertical leg of the groove 48 to position 5 where it engages a diagonal surface 50. Further downward motion of the cam follower pin 46 wedges the cam slide 42 to the left, allowing the pin to move into position 6 as viewed in FIG. 4. Here the pin 46 engages a notch 52 which acts as a stop to prevent further downward motion of the cam follower pin 46 and rod 34. When the pin 46 is engaged in the notch 52, the push-button 24 can be pushed firmly into position to fully engage the spring socket 38 with the end of the rod 34. The stop position 52 prevents the rod 34 from moving downwardly far enough to actuate the switch 40. Thus the notch 52 acts as a safety stop during replacement of the push-button 24. When pressure on the push-button is released, the springs 32 and 39 move the push-button 24, rod 34, and cam follower pin 46 upwardly out of the notch 52. This brings the pin 46 into position 7 as viewed in FIG. 4, where it engages a diagonal surface 54, causing the cam slide to be wedged to the left until the cam follower pin 46 reaches position 8. This is the normal operating position of the push-button switch.

When the push-button switch is subsequently pushed in to operate the switch, the cam follower pin 46 moves down a vertical leg of the cam slot 48 through positions 9 and 10 where it engages a diagonal surface 56, wedging the slide 42 to the left. As the push-button is further depressed, the cam follower 46 moves into position 11 where it engages a diagonal surface 58, wedging the cam slide to the right until the cam follower pin 46 moves into engagement with a notch 60 at position 12. In moving to position 12 the rod 34 has moved sufficiently to actuate the switch 40.

On release of the push-button, the pin 46 moves vertically to position 13 where it engages the diagonal surface 62, allowing the cam slide 42 to move to the right and the cam follower pin 46 to move to position 14. Here the pin engages a reverse notch 64 which limits the outward movement of the push-button 24 and thereby retains the switch in the "on" position. On again depressing the push-button 24, the cam follower pin 46 is moved downwardly to position 15 where it engages a diagonal surface 66, wedging the cam slide 42 to the right. The cam follower 46 continues to move down into position 16 where it engages a notch 68 limiting further downward movement of the push-button. When the push-button is again released, the cam follower pin 46 moves from position 16 vertically upwardly to position 17 where it engages a diagonal surface 70 in the groove 48. This wedges the cam slide 42 to the left allowing the cam follower pin to move from position 17 to position 18 and back up to the home or normal position at 8.

To remove the push-button 24 for relamping or the like, the push-button 24 is pulled from the housing. This moves the cam following pin 46 from position 8 vertically upwardly against a diagonal surface 72 in the cam groove 48, causing the cam slide 42 to move to the right. This allows the pin 46 to move vertically to position 1 where the vertical movement of the rod 34 is stopped, causing the spring socket 38 to be withdrawn from the end of the rod 34 as the push-button 24 is separated from the switch assembly. Reinserting the push-button 24, as described above, causes the rod 34 to move the cam follower pin 46 against the safety stop formed by the notch 52 at position 6 without operation of the switch.

In the alternative arrangement shown in FIGS. 5–11, a cam member 74 is fixed to the rod 34 between the cross-members 36. While the rod 34 is free to move axially, it is prevented from rotating by any suitable means, such as making the rod non-circular in cross-section or by having the cam member 74 engage suitable vertical guides (not shown). The cam member includes a cam groove 76 which is engaged by a cam follower pin 78. The pin 78 is supported on a horizontal slide member 80 which slidably engages grooves in the frame members 36. The cam pin 78 is urged toward the groove in the cam member 74 by a compression spring 82. Thus variations in the depth of the cam groove 76 cause the pin 78 to move axially. Relative vertical motion between the cam member 74 and the pin 78 is accommodated by vertical movement of the rod 34, while relative horizontal movement between the cam member 74 and the cam follower pin 78 is accommodated by the horizontal slide member 80.

Referring to FIGS. 7–11, the FIG. 7 shows the cam member 74 in the uppermost position corresponding to the position in which the push-button 24 is pulled away from the switch assembly. The cam follower pin 78 is in position 1, shown in FIG. 7. When the push-button is replaced and pushed into position, the cam member 74 moves down to the position shown in FIG. 11, with the pin in position 6 against a notch 82 in the cam groove 76. As the cam member moves down, the cam follower pin 78 engages a diagonal surface 84, causing the slide 80 and the pin 78 to move to the right, as viewed in FIG. 11. The diagonal surface results from the fact that the bottom of the groove 76 at position 1 and 2, as indicated at $F_1$, is deeper than adjacent portions of the groove, as shown in FIGS. 9 and 10. At position 3, the spring loaded cam follower pin 78 moves along an incline surface or ramp, indicated at $R_1$. On reaching the top of the ramp at position 4 in FIG. 11, the cam follower moves along a surface $F_2$, and on reaching position 5 drops off onto a slightly deeper bottom surface of the groove, as indicated at $F_3$.

With the cam follower locked in the notch 82, the push-button can be firmly pushed back into engagement with the switch assembly without actuating the switch.

After reinsertion, when the push-button is released, the springs 32 cause the cam member 74 to move upwardly into the position shown in FIG. 12. During the upward movement of the cam member, the cam follower pin moves from position 6 to engagement with the diagonal surface 86 along the surface $F_3$ until it moves into a vertical leg of the cam groove 76 into position 10, which is the "home" position corresponding to the "off" position of the push-button switch. The bottom of the vertical leg has a surface $F_4$ which is slightly deeper than the bottom surface $F_3$ but not as deep as the bottom surface $F_1$, as seen in FIG. 9. When the push-button is again removed, the cam member 74 moves back up into the position shown in FIG. 7 and the cam follower pin 78 returns to the position 1.

When the push-button is used to operate the swtich, the cam member 74 is moved downwardly by the push-button to the position shown in FIG. 13. The cam follower pin 78 moves upwardly relative to the cam groove 76 until it engages a diagonal surface 90. When moved to the position 14, the cam follower 78 is moved axially as it moves through position 14 to position 15 under the wedging action of a ramp, indicated at $R_2$. At position 15, the bottom of the groove is formed by surface $F_5$. In moving from position 15 to position 16 with further downward movement of the cam member 74 by the push-button, the cam follower pin drops off a ledge formed by a diagonal surface 92 onto surface $F_6$. Downward movement of the cam member 76 is interrupted when the pin engages a notch 94 at the top of the cam groove 76. When the push-button is released, the cam member 74 is urged upwardly again by the return springs 32. This causes the cam pin 78 to come in contact with the diagonal surface 92, moving the cam follower pin 78 and slide 80 to the left into position 18. This brings the cam follower pin into engagement with a notch 96 formed in a stop portion 98 of the cam member 74. In moving from position 16 to position 18, the pin moves past a curved lip 100 between surface $F_6$ and surface $F_7$. The stop 98 holds the push-button and the cam member 74 in the "on" position of the switch.

If the push-button is again depressed and then released, the cam follower pin moves from position 18 to 19 and from position 19 back to the "home" position 10. In moving from position 18 to 19 the pin drops off an edge formed by a diagonal surface 102 between surface $F_7$ and $F_8$ in the bottom of the groove 76. In moving from position 19 to position 22 the cam follower moves up a ramp $R_3$ to the level of surface $F_9$. The pin is then deflected to the right by a diagonal surface 104, over the lip formed by the diagonal surface 90 onto the surface $F_4$ back to the home position 10.

From the above description it will be seen that a push-button switch is provided in which the push-button can be removed from the switch assembly merely by pulling the push-button away from the switch. When the push-button is reinserted into the switch assembly by pushing it back into place, the switch is prevented from being actuated by a safety stop position in the controlling cam and cam follower assembly.

What is claimed is:

1. A push-button switch assembly comprising: a housing, a switch mounted in the housing, a push-button projecting from the housing, means including a spring movably supporting the push-button in the housing and biasing the push-button away from the housing, means linking the push-button to the switch for actuating the switch when the push-button is depressed against the spring, said linking means including means disengaged from the push-button by pulling the push-button away from the housing and engaged by pushing the push-button back into the housing, means momentarily locking the linkage to prevent the switch from being actuated when the push-button is reattached to the linkage means by pressing the push-button back into the housing, and means releasing the locking means when pressure applied to the push-button to reattach it to the linkage is removed, said means locking the linkage including a cam member having a groove, a cam follower engaging the groove, means connected to said linkage means for moving the cam follower relative to the cam member in a first direction in response to movement of the push-button, the cam follower being movable relative to the cam member in a second direction transverse to said first direction, said groove having first and second legs substantially parallel to said first direction, the cam follower moving along said first leg when the push-button is depressed to actuate the switch, means directing the cam follower from the first leg into the second leg when the push button is pulled away from and pushed back into the housing a third leg extending between the first and second legs, the third leg joining the end of the second leg of the groove and forming a stop to block movement of the cam follower in said first direction when it is moved to said end of the second leg by pressing on the push-button during reattachment of the push button was inserted, the third leg intersecting the first leg at an intermediate point, the spring urging the cam follower along the third leg back into the first leg on release of pressure on the push-button.

2. Apparatus of claim 1 wherein said linking means detachably connects the push-button directly to the cam member for moving the cam member and push-button as a unit, the push-button detaching from the cam member when the push-button is pulled away from the housing, the cam follower including a slide member, guide means supporting the slide member relative to the housing for movement transverse to the movement of the cam member, and a guide pin projecting from the slide member and engaging the groove in the cam member.

3. Apparatus of claim 2 wherein the guide pin is spring-loaded to permit movement of the pin toward and away from the cam member with changes in depth of the groove.

4. Apparatus of claim 1 wherein said linking means connects the push-button directly to the cam follower, guide means supporting the cam member relative to the housing for movement of the cam member transverse to the movement of the cam follower, the cam follower including a guide pin engaging the groove in the cam member.

5. In a switch device having first and second operative positions actuated by movement of an associated push-button, apparatus for permitting the push-button to be withdrawn and replaced without actuating the switch device, comprising: a cam member having a cam groove, a cam follower engaging the groove and movable along the path of the groove, means connected to the push-button for moving the cam follower relative to the cam member along the groove, means releasing the push-button when it is pulled away from the device and re-engaging the push-button when the push-button is pushed back into the device, the cam follower being positioned at a first position in said groove when the push-button is in its normal position, means responsive to pulling the push-button to remove it from the device for moving the cam follower relative to the cam member along said groove, the groove having a stop formed by a reverse bend in said groove, means responsive to pushing the push-button back into engagement with the device for moving the cam follower relative to the cam member to a position against said stop, the stop limiting movement of the push-button relative to the switch device to prevent actuation of the device, spring means moving the cam follower relative to the cam member away from the stop along the groove back to said first position when pressure on the push-button is released, the groove having a branch path extending away from said first position, and means responsive to movement of the push-button for moving the cam follower relative to the cam member from said first position along said branch path sufficiently to permit the device to be moved to its second operative position by the push-button.

6. Apparatus of claim 5 wherein the cam follower is connected to and movable along a linear path by the push-button, and the cam member is movable along a linear path transverse to the path of movement of the cam member.

7. Apparatus of claim 5 wherein the cam member is connected to and movable along a linear path by the push-button, and the cam follower is movable along a linear path transverse to the path of movement of the cam follower.

8. Apparatus of claim 7 wherein the cam follower includes a pin engaging the groove in the cam member, and spring means urging the pin axially toward the cam member, the groove changing depth and including inclines followed by drop-off ridges for limiting movement of the cam follower pin to one direction along the closed loop path of the groove.

9. Apparatus of claim 5 wherein said branch path includes a second closed loop path having an intermediate stop position for holding the push-button and device in the actuated condition when the push-button is depressed.

* * * * *